US006836626B2

(12) United States Patent
Hooper et al.

(10) Patent No.: US 6,836,626 B2
(45) Date of Patent: Dec. 28, 2004

(54) FUSER TEMPERATURE CONTROL BASED ON IMAGE DENSITY

(75) Inventors: Howard G. Hooper, Boise, ID (US); Dean J. Richtsmeier, Bois, ID (US); David R. Larson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/175,129

(22) Filed: Jun. 19, 2002

(65) Prior Publication Data

US 2003/0235421 A1 Dec. 25, 2003

(51) Int. Cl.[7] ..... G03G 15/20
(52) U.S. Cl. ..... 399/69
(58) Field of Search ..... 399/69, 67; 219/216

(56) References Cited

U.S. PATENT DOCUMENTS 5,241,159 A 8/1993 Chatteriee et al.
5,361,124 A 11/1994 Rowe et al.
5,428,434 A * 6/1995 Hirao ..... 399/336
5,512,992 A 4/1996 Kim et al.
5,768,654 A 6/1998 Noguchi et al.
6,088,547 A 7/2000 Martin et al.
6,157,793 A 12/2000 Weaver et al.
6,163,662 A 12/2000 Martin et al.
6,252,207 B1 6/2001 Cahill et al.

FOREIGN PATENT DOCUMENTS

JP 2-213888 * 8/1990
JP 3-291673a * 12/1991
JP 4-160010a * 12/1993
JP 6-161196 * 7/1994
JP 9-96991a * 4/1997
JP 2002 351251 * 12/2002

* cited by examiner

*Primary Examiner*—Quana Grainger

(57) ABSTRACT

A printing device includes a printing mechanism including a fuser heating element and an image analysis device. The image analysis device performs an image analysis on a print job in order to determine an image density of at least a portion of the print job. A fuser heating element temperature is controlled according to the image density.

15 Claims, 2 Drawing Sheets

FUSER TEMPERATURE CONTROL BASED ON IMAGE DENSITY

FIELD OF THE INVENTION

The present invention relates generally to a printing device, and more particularly to a printing device that includes a fuser and fuser heating element.

BACKGROUND OF THE INVENTION

Printing devices are widely used for creating printed outputs, documents, or pictures, for copying or modifying existing documents, and so forth. Therefore, many types of printing devices are available that generate a printed output, including text, graphics, images, etc.

One type of printing mechanism deposits toner on a sheet of paper and then a fuser component of the printing mechanism heats the toner to fuse the toner to the paper. The toner must be heated to a specific temperature range in order to fuse to the paper. The temperature range is typically about 165 degrees to about 205 degrees Celsius, but may additionally range from 125 to 250 degrees Celsius.

In the prior art, the fuser generally operates at a constant temperature. The prior art may include a fuser temperature control circuit or a processor that monitors the fuser temperature and keeps it at a constant level.

However, there are several drawbacks in the prior art approach. One problem is that the ideal temperature for fusing depends on the amount of toner in the region being fused. The fusing may apply too much heat when fusing a region of heavy toner. Conversely, fusing may apply insufficient heat when fusing a region of light toner. Therefore, the prior art constant temperature approach only works optimally for printing of average toner amounts—a "one mode fits all" approach. As a result, the fusing may be uneven and of poor quality. Furthermore, overheating may occur and damage to the fuser may result. One type of damage is cracking of a fusing element.

In some prior art printing devices, the user may set the fuser temperature for different paper sizes and thicknesses. However, such an approach still does not accommodate the amount of toner being fused, i.e., it does not accommodate the image density. In addition, this approach suffers in that it is not automatic and the user may forget to change settings. Moreover, the user may have to learn how to perform a temperature selection, and the selection will take time to enter from the control panel of the printing device.

Therefore, there remains a need in the art for improvements in printing devices.

SUMMARY OF THE INVENTION

A printing device comprises a printing mechanism including a fuser heating element and an image analysis device. The image analysis device performs an image analysis on a print job in order to determine an image density of at least a portion of the print job. A fuser heating element temperature is controlled according to the image density.

DETAILED DESCRIPTION

Figure 1:
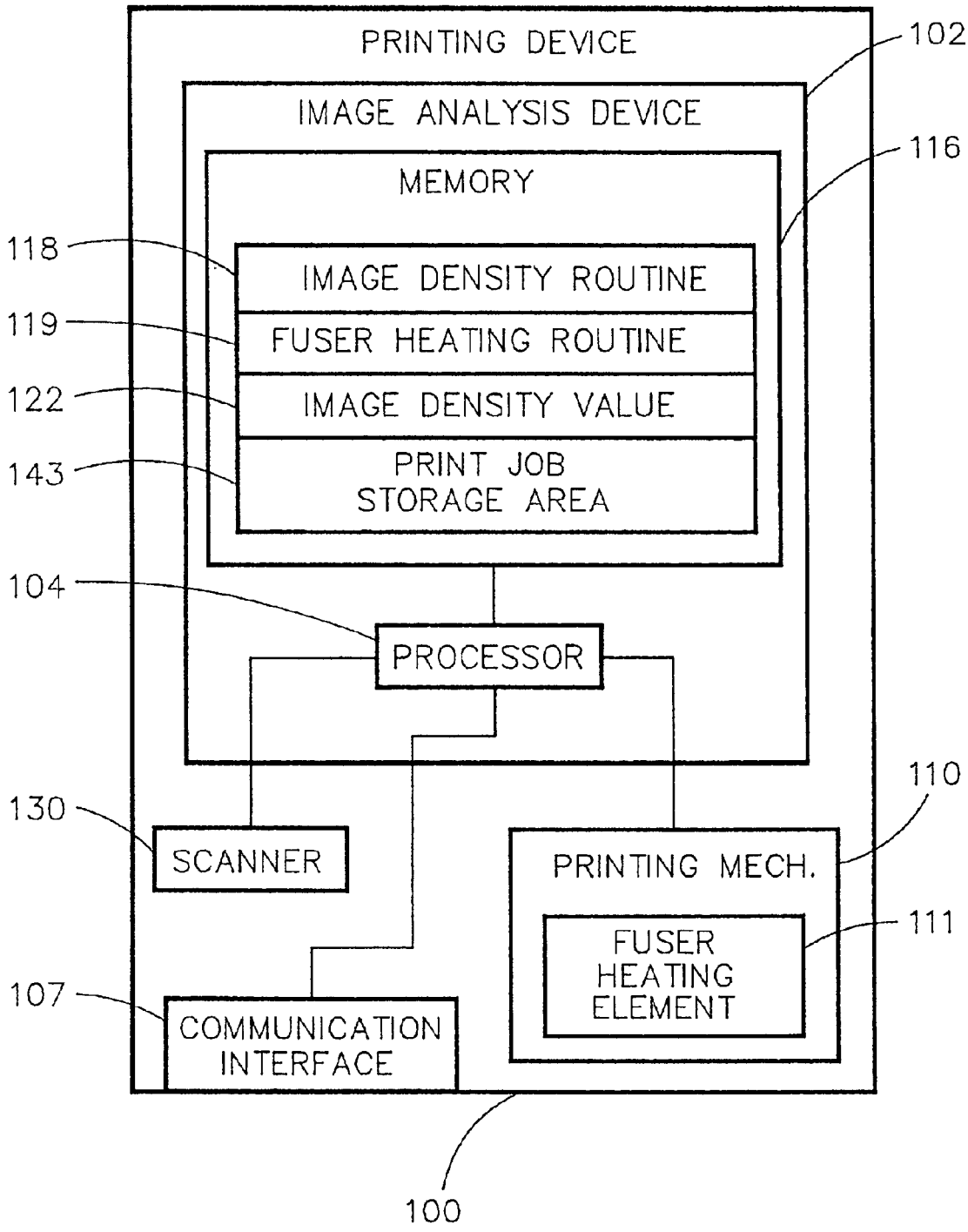
FIG. 1 s a schematic of a printing device according to one embodiment of the invention.

FIG. 1 is a schematic of a printing device 100 according to one embodiment of the invention. The printing device 100 may include an image analysis device 102, a printing mechanism 110, a communication interface 107, and a scanner 130.

The printing device 100 may be any type of electronic device capable of printing by fusing toner to paper. For example, the printing device 100 may comprise a printer, a copier, a facsimile machine, a printer copier device, a facsimile/copier device, a printer/facsimile/copier device, etc.

The printing mechanism 110 includes a fuser heating element 111 that is capable of fusing toner. In one embodiment of the printing mechanism 110, a fuser roller includes a fuser heating element 111 that performs the toner fusing function.

The image analysis device 102 determines an image density of a print job and controls the fuser heating element temperature according to the image density. In one embodiment, the image analysis device 102 comprises a processor 104 and a memory 116.

The communication interface 107 is an optional component. The communication interface 107 conducts communications with other computers and computerized devices, and therefore may be any manner of computer network card, telephone line interface, wireless interface, etc. The communication interface 107 may be included if the printing device 100 is capable of receiving a print job from an external source. For example, the printing device 100 may be a printer connected to a computer or connected to a digital computer network.

The scanner 130 may be any type of available scanner device. The scanner 130 is capable of scanning a document and creating a representative digital data output. If the printing device 100 is a printer/copier device, a facsimile/copier device, etc., the scanner 130 may be an internal component. Alternatively, the scanner 130 may be an external device that provides a digital image representation to the printing device 100 via the communication interface 107.

The processor 104 may be any type of general purpose processor. The processor 104 executes a control routine contained in the memory 116. In addition, the processor 104 receives inputs and controls printing operations of the printing device 100.

The memory 116 may be any type of digital memory. The memory 116 may include, among other things, an image density routine 118, a fuser heating routine 119, and an image density value 122. In addition, the memory 116 may include a print job storage area 143 and may store software or firmware to be executed by the processor 104.

The image density routine 118, when executed by the processor 104, operates on digital image data and generates an image density value based on the amount of toner to be used during printing. The image density routine 118 therefore may execute some manner of image density algorithm that calculates an image density from the amount of toner to be deposited.

The image density value 122 stores a current image density of a print job. The image density value 122 may be calculated for a print job received from the scanner 130. Alternatively, the image density value 122 may be calculated for a print job received via the communication interface 107.

The image density is a numerical representation of the amount of toner to be deposited and fused on an area to be printed. The image density value may vary throughout the print job, and may not necessarily be constant. Therefore, the image density value 122 may be a substantially instantaneous image density value, i.e., the image density routine 118 may operate on only a portion of the print job. In addition, the image density value 122 may be periodically calculated, and therefore may act as a sliding sampling window that is substantially centered on a region of the print job being printed. A sampling window may overlap a previous sampling window.

A typical printer fuser consists of two rollers pressed together. At least one of the rollers is soft and deforms under the contact. This causes a contact area (i.e., a nip), with the contact area defining the nip width. The nip width typically ranges from about 1 to about 20 millimeters (mm). In one embodiment, an image density sampling region of the image equal to the fuser nip width is analyzed and the temperature is set as the image density sampling region enters the nip.

The sampling period may correspond to the speed of the printer and the fuser nip width. For a 14 page-per-minute printer, the paper is moving at a speed of about 89 millimeters per second. Consequently, the sampling rate for a sampling region 4 mm in width is about 81 milliseconds.

It should be understood that any amount of the image may be used to determine the density value. In a practical sense, the image density sampling region is related to the width of the nip of the fuser and how fast the fuser can respond to temperature changes.

The fuser heating routine 119 is used by the processor 104 to generate a temperature control signal for the fuser heating element 111. The temperature control signal is based on the image density. The fuser heating routine 119 may include a look-up table that looks up an image density value and generates a temperature control signal in response. A low image density value input therefore will generate a lower temperature control signal from the look-up table. Alternatively, the fuser heating routine 119 may include a conversion formula. The image density value 122 is inserted into the conversion formula and the conversion formula generates a temperature control signal in response.

The print job storage area 143 may temporarily store at least a portion of a print job. Therefore, when a print job is received, it may be stored in the print job storage area 143 until it is printed.

In operation, the printing device 100 obtains a print job via the communication interface 107 or via the scanner 130. The printing device 100 determines the image density and uses the fuser heating routine 119 to generate a temperature control signal. The printing device 100 controls the fuser heating element temperature according to the temperature control signal.

Figure 2:
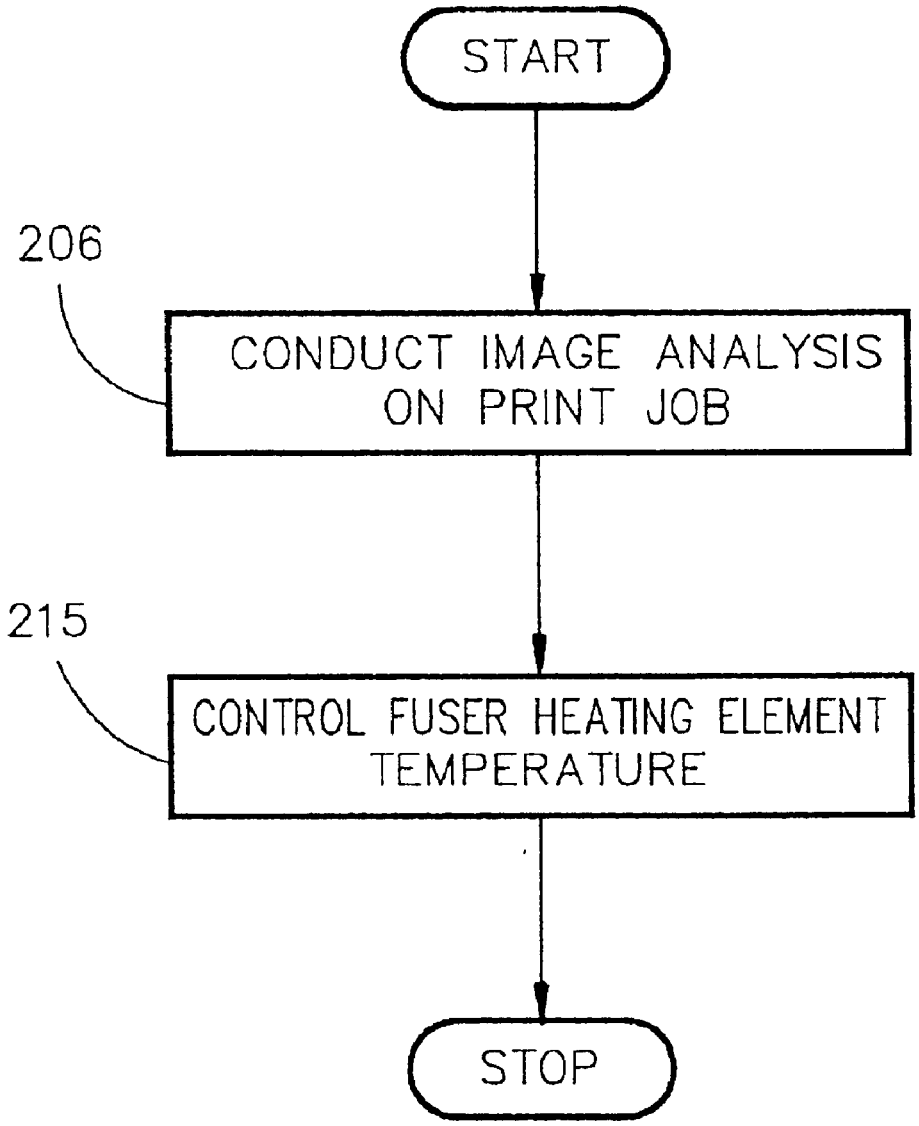
FIG. 2 illustrates, in flowchart form, the operations performed by another embodiment of the invention.

FIG. 2 illustrates, in flowchart form, the operations performed by another embodiment of the invention. In block 206, an image analysis is conducted on a print job. The print job may be obtained from an external source via the communication interface 107 or may be obtained from the scanner 130. The image analysis determines an image density of at least a portion of a print job.

In one embodiment, the image analysis may include applying the image density routine 118 to a portion of the print job in order to generate the image density value 122. Consequently, the image density value 122 may be a substantially instantaneous image density value.

Subsequently, a temperature control signal may be generated from the image density value 122. The temperature control signal may be generated using a look-up table that correlates the image density value 122 to a fuser temperature value. Alternatively, the temperature control signal may be generated by using a conversion formula that converts the image density value 122 to the fuser temperature value.

In one embodiment, a running average image density algorithm is used. In the case of the 4 millimeter nip image density sampling region previously mentioned, a letter page with 25.4 millimeter margins has 368,503 pixels when printing at 600 dpi (dots per inch). The 8-bit value of 255 is assigned to a white pixel and a value of 0 is assigned to a black pixel. Subsequently, a running sum of the 368,503 pixels may be kept and then divided by the number of pixels in order to obtain the running average. The running average is the average toner coverage for the image density sampling region.

In another embodiment, a more complicated image density algorithm may determine whether an image density sampling region contains only black and white pixels (i.e., pixels with values of only 0 and 255), only gray values (values of 1 to 254), or a combination thereof. A method for determining the image density algorithm may keep a running tally of the number of black and white pixels in the image density sampling region, in addition to the running average. The three numbers (running average, total black pixels, and total white pixels) characterize the image density of the image density sampling region.

It should be understood that the two calculation methods given above are merely representative and the image density may be determined in many ways. The method of obtaining the image density value may be a trade-off between speed of computation and desired accuracy of the computation.

In block 215, the fuser heating element temperature is controlled, such as by using the temperature control signal. This allows the fuser heating element temperature to be varied in order to optimally fuse the toner. As a result, an optimal fuser temperature is generated according to the amount of toner to be fused.

The conversion of the image density value into a temperature value may depend on the printing system, and may be tuned for a range of coverage values for a specific printer. In one embodiment, using the running average image density computation discussed above, the resulting image density value will range from 0 (black) to 255 (white). A table may then be used to convert the image density value to a fuser temperature value. For example, for a Hewlett-Packard LASERJET printer running at 10–15 pages per minute (ppm), the following table may be used. In the case of fuser setting number 6 of the table, the region is nearly white.

TABLE 1

| Image Density Running Average | | |
|---|---|---|
| Fuser Setting Number | Running Average Range | Fuser Temperature Setting |
| 1 | 0–50 | 165 |
| 2 | 51–102 | 170 |
| 3 | 103–154 | 170 |
| 4 | 155–206 | 180 |
| 5 | 207–250 | 200 |
| 6 | 251–255 | 165 |

In an embodiment employing the combination method, a similar table of fuser settings may be used. However, unlike the running average method, three tables may be used for the combination method. The appropriate table may be chosen based on the value of the total black and total white pixels in the image density sampling region. If the image density sampling region is predominately white, a white table will be used, with the table values being chosen to accommodate printing a region of very light toner. If the image density sampling region is predominately black, a black table will be used, with the table values being chosen to accommodate printing a region of very heavy toner. If the image density sampling region is gray, a table similar to table 1 above may be used.

It should be understood that the image analysis and the controlling operations may be periodically (or iteratively) performed. The image analysis may generate a plurality of chronological image density values that are used to control the fuser heating element temperature during a printing operation.

The invention differs from the prior art in that the prior art employs a fixed fuser temperature. The prior art does not employ a variable fuser temperature or an automatically variable fuser temperature. The prior art tries to maintain a constant fuser temperature and allows only limited changes to the fuser temperature, such as by paper type. In the prior art, the user has to input the fuser temperature change manually through a control panel. The prior art does not measure an image density of a document to be printed and does not use an image density measurement to vary a fuser temperature.

The variable fuser temperature according to the invention provides several benefits. The variable fuser temperature provides more precise control of the fusing temperature and fusing process, and generates an optimal fuser temperature for all printing situations. The variable fuser temperature is not limited to specific print modes or to specific print patterns. The invention provides a variable fuser temperature during a print job and not just between print jobs. The fuser temperature control of the invention is automatic and does not need to be set by the user. Therefore, there is less overheating of the fuser and less likelihood of damage to the fuser due to overheating.

We claim:

1. A printing device, comprising:

a printing mechanism including a fuser heating element; and an image analysis means for periodically performing an image analysis on digital image data included in a print job in order to determine a plurality of chronological image density values for said print job and capable of controlling said fuser heating element;

wherein a fuser heating element temperature is controlled according to said image density values.

2. The printing device of claim 1, further comprising a scanner for generating said print job.

3. The printing device of claim 1, further comprising a communication interface adapted for receiving said print job from an external source.

4. A printing device, comprising:

a printing mechanism including a fuser heating element;

a processor communicating with said printing mechanism and said fuser heating element; and a memory communicating with said processor and including a fuser heating routine and an image density value;

wherein said processor is configured to periodically perform an image analysis on digital image data included in a print job in order to determine a plurality of chronological image density values for said print job and to control a fuser heating element temperature according to said image density values.

5. The printing device of claim 4, further comprising a print job storage area for storing said print job.

6. The printing device of claim 4, further comprising a scanner for generating said print job.

7. The printing device of claim 4, further comprising a communication interface adapted for receiving said print job from an external source.

8. The printing device of claim 4, with said fuser heating routine further comprising a look-up table that accepts image density values and outputs corresponding temperature control signals.

9. The printing device of claim 4, with said fuser heating routine further comprising a conversion formula that accepts image density values and outputs corresponding temperature control signals.

10. The printing device of claim 4, with said memory further including an image density routine, wherein said image density routine generates said image density values from said print job.

11. A fuser temperature control method for a printing device, comprising the steps of:

conducting an image analysis on digital image data in a print job in order to determine an image density of at least a portion of said print job by periodically applying an image density routine to said digital image data in said print job, wherein said image density routine generates a plurality of chronological image density values for said print job; and controlling a fuser heating element temperature according to said image density.

12. The method of claim 11, further comprising the preliminary step of scanning a document to create said print job.

13. The method of claim 11, further comprising the preliminary step of receiving said print job from an external source.

14. The method of claim 11, with the controlling step further comprising the step of inputting image density values into a look-up table and obtaining corresponding temperature control signals used to control said fuser heating element temperature.

15. The method of claim 11, with the controlling step further comprising the step of inputting said image density into a conversion formula and obtaining corresponding temperature control signals used to control said fuser heating element temperature.

* * * * *